US012297837B2

(12) United States Patent
Avila et al.

(10) Patent No.: US 12,297,837 B2
(45) Date of Patent: May 13, 2025

(54) SUBMERSIBLE PUMP

(71) Applicant: TECHTRONIC CORDLESS GP, Anderson, SC (US)

(72) Inventors: Gerardo Quintanilla Avila, Dongguan (CN); Wai Chung Lee, Kwai Chung (CN)

(73) Assignee: TECHTRONIC CORDLESS GP, Anderson, SC (US)

( * ) Notice: Subject to any disclaimer, the term of this patent is extended or adjusted under 35 U.S.C. 154(b) by 129 days.

(21) Appl. No.: 17/900,512

(22) Filed: Aug. 31, 2022

(65) Prior Publication Data

US 2023/0070541 A1 Mar. 9, 2023

(30) Foreign Application Priority Data

Sep. 9, 2021 (CN) ..... 202111054990.3

(51) Int. Cl.

| | |
|---|---|
| ***F04D 13/08*** | (2006.01) |
| ***F04D 13/06*** | (2006.01) |
| ***F04D 15/00*** | (2006.01) |
| ***F04D 29/40*** | (2006.01) |
| ***F04D 29/60*** | (2006.01) |
| ***F04D 29/70*** | (2006.01) |

(52) U.S. Cl.

CPC ..... *F04D 13/08* (2013.01); *F04D 13/0693* (2013.01); *F04D 15/0066* (2013.01); *F04D 29/406* (2013.01); *F04D 29/605* (2013.01); *F04D 29/708* (2013.01)

(58) Field of Classification Search

CPC .. F04D 13/08; F04D 13/0693; F04D 15/0066; F04D 29/406; F04D 29/605; F04D 29/708

See application file for complete search history.

(56) References Cited

U.S. PATENT DOCUMENTS

| | | | |
|---|---|---|---|
| 3,021,788 | A | 2/1962 | Kaatz |
| 3,335,668 | A | 8/1967 | Thon |
| 3,579,657 | A | 5/1971 | Gurrieri |
| 3,698,830 | A | 10/1972 | Goyne |

(Continued)

FOREIGN PATENT DOCUMENTS

| | | |
|---|---|---|
| AU | 2005100918 | 12/2005 |
| AU | 2008200609 | 9/2008 |

(Continued)

OTHER PUBLICATIONS

English Translation of WO 2016/162087 A1 (Year: 2016).*

(Continued)

*Primary Examiner* — Connor J Tremarche

(74) *Attorney, Agent, or Firm* — Dority & Manning, P.A.

(57) ABSTRACT

A submersible pump, comprising: a casing, having accommodated therein a pumping unit and a drive unit for driving the pumping unit; a base, defining a pump inlet; and a float control unit. The float control unit comprises: a float, having at least one magnet; and a float chamber housing, defining a float chamber in which the float is movable up and down. The float chamber has at least one opening which connects the float chamber with an external environment. At least part of the float chamber housing is movably or removably attached to an outer wall of a casing of the submersible pump.

21 Claims, 9 Drawing Sheets

(56) References Cited

U.S. PATENT DOCUMENTS 3,814,544 A 6/1974 Roberts et al.
4,108,574 A 8/1978 Bartley et al.
4,165,532 A 8/1979 Kendall et al.
4,806,083 A 2/1989 Lagrange et al.
4,819,681 A 4/1989 Hodak
4,827,155 A 5/1989 Firebaugh
4,830,040 A 5/1989 Eng
4,853,984 A 8/1989 Celiano
4,922,433 A 5/1990 Mark
4,936,508 A 6/1990 Ingalz
5,073,736 A 12/1991 Gschwender et al.
5,074,764 A 12/1991 Kobayashi et al.
5,099,699 A 3/1992 Kobold
5,103,648 A * 4/1992 Barbier ..... G01F 23/2925 62/193
D328,748 S 8/1992 Eng
5,297,939 A 3/1994 Orth et al.
5,324,171 A 6/1994 Cook
5,444,611 A 8/1995 Woytowitz et al.
5,479,338 A 12/1995 Ericksen et al.
5,769,603 A 6/1998 Fujiwara et al.
5,775,877 A * 7/1998 Genz ..... H01H 35/18 73/306
6,146,108 A 11/2000 Mullendore
6,179,558 B1 1/2001 Eastman, III et al.
6,186,743 B1 * 2/2001 Romer ..... F04B 41/06 427/256
6,189,811 B1 2/2001 Rudy
6,298,285 B1 10/2001 Addink et al.
6,390,780 B1 5/2002 Batchelder et al.
6,447,261 B1 9/2002 McCook
6,715,994 B2 4/2004 Patel et al.
6,729,847 B2 5/2004 Rossman
6,766,221 B1 7/2004 Christiansen
6,948,363 B1 9/2005 Karsten et al.
7,012,394 B2 3/2006 Moore et al.
7,058,478 B2 6/2006 Alexanian
7,065,804 B2 6/2006 Rickman
D546,772 S 7/2007 Venegas et al.
7,257,465 B2 8/2007 Perez et al.
7,444,207 B2 10/2008 Nickerson et al.
7,584,023 B1 9/2009 Palmer et al.
7,596,429 B2 9/2009 Cardinal et al.
7,611,074 B2 11/2009 Chen
7,612,529 B2 11/2009 Kochan, Jr.
7,640,079 B2 12/2009 Nickerson et al.
7,650,801 B2 1/2010 Kuhlemann
7,695,251 B2 4/2010 Marioni
7,704,050 B2 4/2010 Marioni
7,769,494 B1 8/2010 Simon et al.
7,802,618 B2 9/2010 Simon et al.
7,844,367 B2 11/2010 Nickerson et al.
7,853,363 B1 12/2010 Porter et al.
7,874,808 B2 1/2011 Stiles
7,949,433 B2 5/2011 Hern et al.
8,083,502 B2 12/2011 Ballu
8,083,835 B2 12/2011 Mittelmark et al.
8,167,578 B2 5/2012 Lin et al.
8,200,368 B2 6/2012 Nickerson et al.
8,209,061 B2 6/2012 Palmer et al.
8,454,330 B2 6/2013 Lyngholm
8,454,729 B2 6/2013 Mittelmark et al.
8,527,219 B2 9/2013 Camilleri
8,545,194 B2 10/2013 Irving et al.
8,550,788 B2 10/2013 Oda et al.
8,565,904 B2 10/2013 Bragg et al.
8,571,798 B2 10/2013 Atherton
D693,371 S 11/2013 Orsini
8,579,600 B2 11/2013 Vijayakumar
8,606,415 B1 12/2013 Woytowitz et al.
8,622,706 B2 1/2014 Burgess et al.
8,636,910 B2 1/2014 Irvin, Sr. et al.
8,747,082 B2 6/2014 Yi et al.
8,784,077 B1 7/2014 Ray
8,864,476 B2 10/2014 Moormann et al.
8,894,741 B2 11/2014 Mittelmark
9,010,019 B2 4/2015 Mittelmark
9,028,209 B2 5/2015 Liang et al.
9,057,256 B2 6/2015 Ige et al.
9,161,499 B2 10/2015 Bailey et al.
9,192,110 B2 11/2015 Standerfer et al.
9,258,952 B2 2/2016 Walker et al.
9,261,097 B2 2/2016 Moricca et al.
9,388,820 B2 7/2016 Kean et al.
9,512,965 B2 12/2016 Acklin
9,534,408 B2 1/2017 Osterman et al.
9,540,837 B2 1/2017 Mjelde
9,594,366 B2 3/2017 Klein et al.
9,638,193 B2 5/2017 Bishop et al.
9,660,497 B2 5/2017 Ladd
9,719,515 B2 8/2017 Pohler
9,756,402 B2 9/2017 Stampfl et al.
9,776,309 B2 10/2017 Fluhrer
9,822,539 B1 11/2017 Krombein
9,829,869 B2 11/2017 Ersavas et al.
9,863,440 B2 1/2018 Pol et al.
9,869,326 B2 1/2018 Stark et al.
9,885,360 B2 2/2018 Boese et al.
9,888,300 B2 2/2018 Stampfl et al.
10,087,927 B2 10/2018 Rosinski
10,087,938 B2 10/2018 Dahouk et al.
10,136,198 B2 11/2018 Stampfl et al.
10,138,643 B2 11/2018 Drechsel
10,221,853 B2 3/2019 Nix
10,225,996 B1 3/2019 Kremicki et al.
10,267,316 B1 4/2019 Sandstrom
10,277,964 B2 4/2019 Stampfl et al.
10,295,990 B2 5/2019 Dey, IV et al.
10,364,821 B2 7/2019 Pohler
10,385,859 B2 8/2019 Roussel et al.
10,510,199 B2 12/2019 Hoossainy et al.
10,516,920 B2 12/2019 Stampfl et al.
10,527,052 B2 1/2020 Cailotto et al.
10,634,133 B2 4/2020 Johnson et al.
D886,871 S 6/2020 Wang
10,711,788 B2 7/2020 Mayleben
10,735,833 B2 8/2020 Stampfl et al.
10,788,040 B2 9/2020 Oppermann et al.
10,830,252 B2 11/2020 Turner et al.
10,838,407 B2 11/2020 Dey, IV et al.
10,895,267 B2 1/2021 Petit et al.
10,907,638 B2 2/2021 Wilds et al.
10,941,582 B1 3/2021 Alexander
10,950,074 B2 3/2021 Hoossainy et al.
10,968,899 B2 4/2021 Wu et al.
10,973,183 B2 4/2021 Gungl et al.
10,976,726 B2 4/2021 Dey, IV et al.
10,979,786 B2 4/2021 Stampfl et al.
11,015,585 B2 5/2021 Rosinski
11,029,180 B2 6/2021 Craig
11,168,695 B2 11/2021 Christ et al.
11,172,592 B1 11/2021 Mounioloux
11,178,831 B2 11/2021 Gungl et al.
11,256,234 B2 2/2022 Dey, IV et al.
11,280,338 B2 3/2022 Wang et al.
11,326,614 B2 5/2022 Park
11,333,137 B2 5/2022 Jurmu et al.
11,346,347 B2 5/2022 Smith
11,483,633 B2 10/2022 Stampfl et al.
2005/0164912 A1 7/2005 Bigelow et al.
2005/0244287 A1 11/2005 Dobrynski
2006/0006820 A1 1/2006 Roseman et al.
2006/0032136 A1 2/2006 Chou
2006/0081520 A1 4/2006 Lord et al.
2006/0116791 A1 6/2006 Ravula et al.
2006/0269426 A1 11/2006 Llewellyn
2007/0245478 A1 10/2007 Painter
2008/0031751 A1 2/2008 Littwin et al.
2008/0173086 A1 * 7/2008 McQuaid ..... G01F 23/34 73/317
2009/0038221 A1 2/2009 Poore, Jr.
2010/0303654 A1 12/2010 Petersen et al.
2012/0083929 A1 4/2012 Conrad, Jr.
2013/0001243 A1 1/2013 Quick

(56) References Cited

U.S. PATENT DOCUMENTS

| | | | | |
|---|---|---|---|---|
| 2013/0277078 | A1 | 10/2013 | Wallgren | |
| 2013/0295980 | A1 | 11/2013 | Reuven et al. | |
| 2013/0297335 | A1 | 11/2013 | Mittelmark | |
| 2013/0309099 | A1 | 11/2013 | Irving et al. | |
| 2015/0255773 | A1 | 9/2015 | Yoshinari et al. | |
| 2016/0099575 | A1 | 4/2016 | Velderman et al. | |
| 2016/0158783 | A1 | 6/2016 | Wiebe | |
| 2017/0122325 | A1 | 5/2017 | Seman, Jr. et al. | |
| 2017/0208757 | A1 | 7/2017 | Valmont | |
| 2018/0128272 | A1 | 5/2018 | Mayleben et al. | |
| 2018/0128533 | A1 | 5/2018 | Atalla | |
| 2019/0120233 | A1 | 4/2019 | Wang et al. | |
| 2019/0368374 | A1* | 12/2019 | Hu | F04D 29/685 |
| 2020/0003217 | A1 | 1/2020 | Wilds | |
| 2020/0030809 | A1 | 1/2020 | Böhme et al. | |
| 2020/0063744 | A1 | 2/2020 | Meza et al. | |
| 2020/0256342 | A1 | 8/2020 | Colby et al. | |
| 2020/0386233 | A1 | 12/2020 | Smith | |
| 2021/0067847 | A1 | 3/2021 | Stampfl et al. | |
| 2021/0095694 | A1 | 4/2021 | Garcia et al. | |
| 2021/0108641 | A1 | 4/2021 | Arkwright et al. | |
| 2021/0148739 | A1 | 5/2021 | Elvekjaer et al. | |
| 2021/0183188 | A1 | 6/2021 | Hoossainy et al. | |
| 2021/0194332 | A1 | 6/2021 | Gallagher et al. | |
| 2021/0268552 | A1 | 9/2021 | Zha et al. | |
| 2021/0289692 | A1 | 9/2021 | Zhang et al. | |
| 2021/0310492 | A1 | 10/2021 | Mayleben et al. | |
| 2021/0323033 | A1 | 10/2021 | Sugiura | |
| 2021/0345565 | A1 | 11/2021 | Farringer | |
| 2021/0372114 | A1 | 12/2021 | Cleveland | |
| 2022/0010793 | A1 | 1/2022 | Hoefel et al. | |
| 2022/0025891 | A1 | 1/2022 | Abhyankar et al. | |
| 2022/0048055 | A1 | 2/2022 | Earles et al. | |
| 2022/0049703 | A1 | 2/2022 | Dames et al. | |
| 2022/0099086 | A1* | 3/2022 | Lindeman | F04D 29/406 |
| 2022/0120293 | A1 | 4/2022 | Henton et al. | |
| 2022/0154484 | A1 | 5/2022 | Hof | |
| 2022/0162871 | A1 | 5/2022 | Ramos | |

FOREIGN PATENT DOCUMENTS

| | | | | |
|---|---|---|---|---|
| AU | 2010219332 | | 9/2010 | |
| AU | 2010201149 | | 10/2010 | |
| AU | 2011362817 | | 10/2013 | |
| AU | 2015100587 | | 6/2015 | |
| AU | 2016257438 | | 5/2021 | |
| AU | 2018313025 | | 8/2021 | |
| AU | 2021106103 | | 10/2021 | |
| AU | 2021106106 | | 10/2021 | |
| CA | 2495125 | | 7/2005 | |
| CA | 2736254 | | 3/2010 | |
| CA | 2736271 | | 3/2010 | |
| CA | 2828602 | | 9/2011 | |
| CA | 2810536 | | 4/2012 | |
| CA | 2808176 | | 9/2013 | |
| CN | 1842659 | | 10/2006 | |
| CN | 2881164 | Y | 3/2007 | |
| CN | 201018441 | | 2/2008 | |
| CN | 201144830 | | 11/2008 | |
| CN | 201363287 | | 12/2009 | |
| CN | 201382582 | | 1/2010 | |
| CN | 201479694 | | 5/2010 | |
| CN | 201507456 | | 6/2010 | |
| CN | 102072169 | | 5/2011 | |
| CN | 102215939 | | 10/2011 | |
| CN | 102628434 | | 8/2012 | |
| CN | 102937113 | A | 2/2013 | |
| CN | 102937114 | A | 2/2013 | |
| CN | 202756301 | U | 2/2013 | |
| CN | 102966176 | A | 3/2013 | |
| CN | 103097083 | | 5/2013 | |
| CN | 302435871 | S | 5/2013 | |
| CN | 103161737 | | 6/2013 | |
| CN | 103321915 | A * | 9/2013 | F04D 13/08 |
| CN | 203463246 | | 3/2014 | |
| CN | 203584889 | | 5/2014 | |
| CN | 103958898 | | 7/2014 | |
| CN | 104047869 | | 9/2014 | |
| CN | 203835742 | | 9/2014 | |
| CN | 302960527 | S | 10/2014 | |
| CN | 104218726 | | 12/2014 | |
| CN | 204025087 | | 12/2014 | |
| CN | 204030820 | | 12/2014 | |
| CN | 204140450 | | 2/2015 | |
| CN | 204186609 | | 3/2015 | |
| CN | 104520590 | | 4/2015 | |
| CN | 204517463 | | 7/2015 | |
| CN | 303454186 | S | 11/2015 | |
| CN | 205013259 | | 2/2016 | |
| CN | 205027394 | | 2/2016 | |
| CN | 205190259 | | 4/2016 | |
| CN | 205260351 | U | 5/2016 | |
| CN | 205537872 | | 8/2016 | |
| CN | 205638832 | | 10/2016 | |
| CN | 106168222 | A | 11/2016 | |
| CN | 106246560 | | 12/2016 | |
| CN | 206071897 | | 4/2017 | |
| CN | 206360894 | | 7/2017 | |
| CN | 107044427 | | 8/2017 | |
| CN | 206545602 | | 10/2017 | |
| CN | 206582132 | | 10/2017 | |
| CN | 206668583 | | 11/2017 | |
| CN | 107524635 | A | 12/2017 | |
| CN | 107532598 | | 1/2018 | |
| CN | 206957986 | | 2/2018 | |
| CN | 207393499 | | 5/2018 | |
| CN | 207503200 | | 6/2018 | |
| CN | 108347224 | | 7/2018 | |
| CN | 207598526 | | 7/2018 | |
| CN | 108457904 | A | 8/2018 | |
| CN | 207777212 | | 8/2018 | |
| CN | 108591080 | | 9/2018 | |
| CN | 207813970 | | 9/2018 | |
| CN | 207969496 | | 10/2018 | |
| CN | 208153399 | U | 11/2018 | |
| CN | 109058126 | | 12/2018 | |
| CN | 208316669 | | 1/2019 | |
| CN | 208416977 | U | 1/2019 | |
| CN | 208417035 | U | 1/2019 | |
| CN | 208587308 | | 3/2019 | |
| CN | 208587310 | | 3/2019 | |
| CN | 208816400 | | 5/2019 | |
| CN | 208821510 | | 5/2019 | |
| CN | 208831273 | | 5/2019 | |
| CN | 208885544 | | 5/2019 | |
| CN | 209083651 | | 7/2019 | |
| CN | 110173438 | | 8/2019 | |
| CN | 110206742 | | 9/2019 | |
| CN | 110285075 | | 9/2019 | |
| CN | 110541400 | | 12/2019 | |
| CN | 110552890 | | 12/2019 | |
| CN | 209818317 | | 12/2019 | |
| CN | 209818331 | | 12/2019 | |
| CN | 110805560 | A | 2/2020 | |
| CN | 110821845 | | 2/2020 | |
| CN | 210106193 | | 2/2020 | |
| CN | 210343739 | | 4/2020 | |
| CN | 210397157 | U | 4/2020 | |
| CN | 210397158 | U | 4/2020 | |
| CN | 210428154 | U | 4/2020 | |
| CN | 210565169 | U | 5/2020 | |
| CN | 111396323 | | 7/2020 | |
| CN | 211370758 | U | 8/2020 | |
| CN | 211397953 | U | 9/2020 | |
| CN | 211605031 | U | 9/2020 | |
| CN | 111852882 | | 10/2020 | |
| CN | 211819924 | U | 10/2020 | |
| CN | 111878412 | | 11/2020 | |
| CN | 212028186 | U | 11/2020 | |
| CN | 212202507 | U | 12/2020 | |
| CN | 212225537 | U | 12/2020 | |
| CN | 212272569 | U | 1/2021 | |
| CN | 212296914 | U | 1/2021 | |
| CN | 212318376 | U | 1/2021 | |

(56) References Cited

FOREIGN PATENT DOCUMENTS

| | | | | |
|---|---|---|---|---|
| CN | 212584018 | U | 2/2021 | |
| CN | 212615403 | U | 2/2021 | |
| CN | 212690371 | U | 3/2021 | |
| CN | 212803624 | U | 3/2021 | |
| CN | 213176072 | U | 5/2021 | |
| CN | 213270330 | U | 5/2021 | |
| CN | 112922851 | A | 6/2021 | |
| CN | 112922852 | A | 6/2021 | |
| CN | 112922857 | A | 6/2021 | |
| CN | 112922858 | A | 6/2021 | |
| CN | 113062871 | A | 7/2021 | |
| CN | 113167267 | | 7/2021 | |
| CN | 113339275 | A | 9/2021 | |
| CN | 113396798 | A | 9/2021 | |
| CN | 214330928 | U | 10/2021 | |
| CN | 214577762 | U | 11/2021 | |
| CN | 214616899 | U | 11/2021 | |
| CN | 214698374 | U | 11/2021 | |
| CN | 214837194 | U | 11/2021 | |
| CN | 214944784 | U | 11/2021 | |
| CN | 214945040 | U | 11/2021 | |
| CN | 306950527 | S | 11/2021 | |
| CN | 215109539 | U | 12/2021 | |
| CN | 215211464 | U | 12/2021 | |
| CN | 215292922 | U | 12/2021 | |
| CN | 215409460 | U | 1/2022 | |
| CN | 215830729 | U | 2/2022 | |
| CN | 114233646 | A | 3/2022 | |
| CN | 216009024 | U | 3/2022 | |
| CN | 216142920 | U | 3/2022 | |
| CN | 216142925 | U | 3/2022 | |
| CN | 216241360 | U | 4/2022 | |
| CN | 216381887 | U | 4/2022 | |
| CN | 216588984 | U | 5/2022 | |
| CN | 216714739 | U | 6/2022 | |
| DE | 2433802 | A1 | 1/1976 | |
| DE | 2746890 | A1 | 4/1979 | |
| DE | 3332050 | A1 | 4/1985 | |
| DE | 3607466 | A1 | 9/1987 | |
| DE | 8812392 | U1 | 8/1989 | |
| DE | 9106820 | U1 | 7/1991 | |
| DE | 4239071 | A1 | 5/1994 | |
| DE | 19500280 | A1 | 7/1996 | |
| DE | 29711534 | U1 | 8/1998 | |
| DE | 10039295 | A1 | 3/2002 | |
| DE | 10256792 | A1 | 3/2004 | |
| DE | 102005031420 | A1 | 1/2007 | |
| DE | 102006016982 | B3 | 10/2007 | |
| DE | 102009054323 | A1 | 6/2011 | |
| DE | 102011120837 | A1 | 6/2013 | |
| DE | 102013005517 | A1 | 10/2013 | |
| DE | 202013010312 | U1 | 2/2015 | |
| DE | 102014206895 | A1 | 10/2015 | |
| DE | 202015101176 | U1 | 6/2016 | |
| DE | 202016103632 | U1 | 7/2016 | |
| DE | 202018104553 | U1 | 9/2018 | |
| DE | 202018104627 | U1 | 11/2018 | |
| DE | 202018106816 | U1 | 12/2018 | |
| DE | 102018116204 | A1 | 1/2020 | |
| DE | 102018216802 | A1 | 4/2020 | |
| DE | 202020105706 | U1 | 10/2020 | |
| DE | 102019218525 | A1 | 6/2021 | |
| EP | 0887553 | A1 | 12/1998 | |
| EP | 1130267 | A1 | 9/2001 | |
| EP | 1186782 | A1 | 3/2002 | |
| EP | 1233188 | A1 * | 8/2002 | ..... F04D 15/0227 |
| EP | 1454066 | A1 | 9/2004 | |
| EP | 1454885 | A2 | 9/2004 | |
| EP | 1455092 | A2 | 9/2004 | |
| EP | 1972792 | A2 | 9/2008 | |
| EP | 2365294 | A1 | 9/2011 | |
| EP | 2609336 | A1 | 7/2013 | |
| EP | 2698544 | A1 | 2/2014 | |
| EP | 2740940 | A1 | 6/2014 | |
| EP | 3228869 | A1 | 10/2017 | |
| EP | 3332127 | A1 | 6/2018 | |
| EP | 3581803 | A1 | 12/2019 | |
| EP | 3746660 | A1 | 12/2020 | |
| EP | 3746661 | A1 | 12/2020 | |
| ES | 1227680 | U | 4/2019 | |
| ES | 1254621 | U | 10/2020 | |
| FR | 1352468 | A | 2/1964 | |
| FR | 2841093 | A1 | 12/2003 | |
| FR | 3008748 | A1 | 1/2015 | |
| FR | 3101225 | A3 | 3/2021 | |
| GB | 893556 | A | 4/1962 | |
| GB | 932801 | A | 7/1963 | |
| GB | 1021667 | A | 3/1966 | |
| GB | 1470987 | A | 4/1977 | |
| JP | 2019073995 | A | 5/2019 | |
| MX | 356905 | B | 5/2018 | |
| WO | WO2010141979 | A1 | 12/2010 | |
| WO | WO2011055362 | A1 | 5/2011 | |
| WO | WO2011091809 | A1 | 8/2011 | |
| WO | WO2014187433 | A2 | 11/2014 | |
| WO | WO 2016008510 | A1 | 1/2016 | |
| WO | WO-2016162087 | A1 * | 10/2016 | ..... F04D 13/086 |
| WO | WO2016173660 | A1 | 11/2016 | |
| WO | WO2019000172 | A1 | 1/2019 | |
| WO | WO2019149390 | A1 | 8/2019 | |
| WO | WO2019149391 | A1 | 8/2019 | |
| WO | WO2019223045 | A1 | 11/2019 | |
| WO | WO2022022870 | A1 | 2/2022 | |
| WO | WO2022073657 | A1 | 4/2022 | |

OTHER PUBLICATIONS

English Translation of CN 103321915 A (Year: 2013).*

European Search Report Corresponding with Application No. EP22191396 on Feb. 22, 2023 (2 pages).

European Search Report Corresponding with Application No. EP22204705 on Feb. 10, 2023 (2 pages).

U.S. Appl. No. 10/104,455, filed Sep. 25, 2003, Ambriz Daniel Mark.

* cited by examiner

SUBMERSIBLE PUMP

This application claims the benefit of priority to Chinese Patent Application No. 2021110549903, filed on Sep. 9, 2021, the disclosure of which is incorporated by reference herein in its entirety.

TECHNICAL FIELD

The present invention relates to a submersible pump, in particular to a float control unit for a submersible pump.

BACKGROUND ART

Submersible pumps can be used to carry out various tasks, including garden irrigation, rainwater collection and pool drainage. During normal operation, a submersible pump is immersed in a water source, and a drive unit located in a housing of the submersible pump can effectively utilize the flow of water to dissipate heat. As the water is steadily extracted, the water surface gradually falls, and part of a casing of the submersible pump is exposed above the water surface. Although part of the casing is exposed to the surrounding air at this time, the casing generally has no openings due to sealing requirements, and consequently, it is difficult for the drive unit to dissipate heat by means of the surrounding air. To solve this problem, submersible pumps in the prior art are generally equipped with a float switch, which is connected to the casing by electrical wires. When the float rises with the water level to a predetermined position, a switch in the float switches on, and the submersible pump begins operating. When the float falls with the water level to a minimum operating position, the switch in the float switches off, and the submersible pump stops operating. However, movement of the float in the water is not limited to rising and falling in the vertical direction. Turbulent water flow might cause large-scale movement of the float, resulting in loosening and detachment of the electrical wires. In addition, as it moves, the float might also collide with a body of the submersible pump, resulting in damage to components.

SUMMARY OF THE INVENTION

To overcome the abovementioned shortcomings, the present invention provides a float control unit for a submersible pump, comprising: a float, having at least one magnet; and a float chamber housing, defining a float chamber in which the float is movable up and down, the float chamber having at least one opening which connects the float chamber with an external environment, wherein at least part of the float chamber housing is movably or removably attached to an outer wall of the submersible pump.

The present invention further provides a submersible pump, comprising: a casing, having accommodated therein a pumping unit and a drive unit for driving the pumping unit; a base, defining a pump inlet; and the float control unit described above.

In one embodiment, the casing of the submersible pump comprises a drive unit casing and a pumping unit casing, the pumping unit casing being located between the drive unit casing and the base, and at least part of the float chamber housing being located on an outer wall of the pumping unit casing. The pumping unit casing defines a pumping chamber, the height of the opening of the float chamber being equal to or lower than the height of the top of the pumping chamber.

In one embodiment, the submersible pump further comprises at least one cable retaining slot for retaining a cable, the cable retaining slot being formed on the outer wall of the casing and/or on a handle of the submersible pump.

In one embodiment, the float chamber housing comprises a cover; a rear wall, a sidewall and a bottom wall of the float chamber are formed by the drive unit casing and/or the pumping unit casing, and when in a closed position, the cover forms a front wall of the float chamber.

In one embodiment, the submersible pump further comprises the float control unit further comprising at least one control element which controls the pumping unit in response to the height of the float, the control element preferably being a reed switch.

In one embodiment, the float control unit comprises multiple control elements respectively positioned at different heights in the drive unit casing, and preferably, a user can selectively use any one of the multiple control elements.

In one embodiment, the position of the control element is adjustable without removing the drive unit casing.

In one embodiment, the submersible pump further comprises a pump inlet adjustment mechanism arranged on a flow path between the pump inlet and a pumping chamber, the pump inlet adjustment mechanism comprising a first adjustment part and a second adjustment part capable of moving relative to each other, each of the first adjustment part and second adjustment part comprising multiple adjustment regions with different fluid permeabilities, and relative movement between the first adjustment part and second adjustment part being able to change an effective dimension of the flow path.

In one embodiment, the first adjustment part comprises an adjustment ring on which multiple adjustment regions are distributed, the adjustment ring being rotatable about a central axis thereof relative to the second adjustment part. The multiple adjustment regions may comprise filtration regions and non-filtration regions distributed alternately.

In one embodiment, the second adjustment part comprises blocking regions and open regions arranged in the circumferential direction, the blocking regions being connected to the base or formed integrally with the base, and the open regions being defined between adjacent blocking regions; the effective dimension of the flow path is increased by aligning the non-filtration regions of the adjustment ring with the open regions, and the effective dimension of the flow path is decreased by aligning the filtration regions of the adjustment ring with the open regions.

In one embodiment, the adjustment ring comprises at least one operating part, which passes through at least one slot formed in a bottom wall of the base.

DETAILED DESCRIPTION OF EMBODIMENTS

Figure 1:
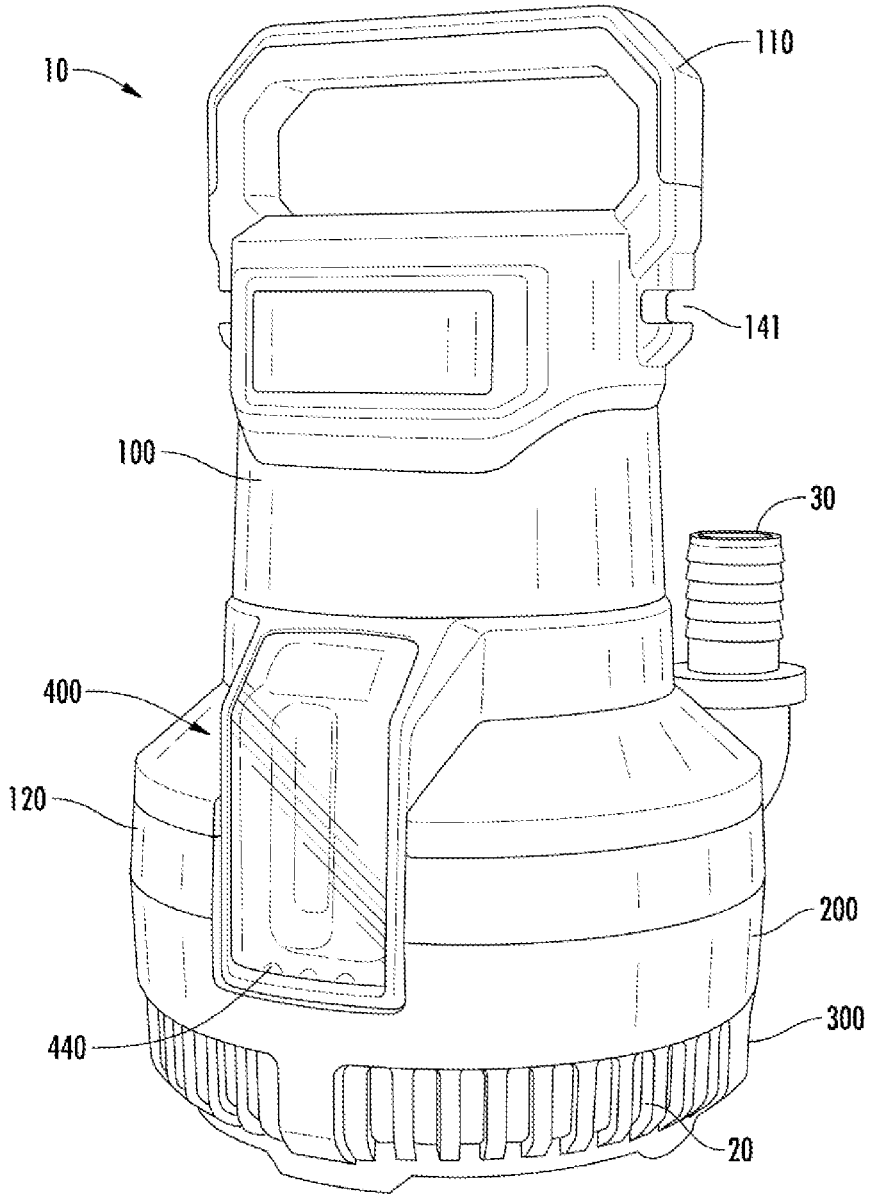
FIG. 1 shows a submersible pump according to an embodiment of the present invention.

FIG. 1 shows a submersible pump according to an embodiment of the present invention; it is used for pumping a fluid such as water. The submersible pump 10 comprises a casing and a base. In this embodiment, an inlet 20 of the submersible pump 10 is defined by the base 300, and an outlet 30 projects outwards from a sidewall of the casing. In some embodiments, the casing may comprise a drive unit casing 100 and a pumping unit casing 200. A drive unit is provided in the drive unit casing 100; the drive unit may be an electric motor, e.g. a brushless DC motor or a brushed DC motor. A pumping unit is provided in the pumping unit casing 200, and comprises a pumping chamber, and an impeller located in the pumping chamber and driven by the electric motor. The impeller may be a centrifugal impeller or an axial-flow impeller. In the embodiment of FIG. 1, the drive unit casing 100 and pumping unit casing 200 are independent of each other, and the pumping unit casing 200 is removably fitted to the bottom 120 of the drive unit casing 100, so that a user can easily replace the electric motor or impeller when needed. To prevent fluid from entering the pumping unit casing 200 and damaging the electric motor, a seal may be provided between the drive unit casing 100 and the pumping unit casing 200. The base 300 is connected to the pumping unit casing 200, and used to stably support the entire submersible pump. For example, when the submersible pump is used for extracting water from a pool, the base 300 may contact a bottom wall of the pool. The structure of the base 300 is described in detail below with reference to FIGS. 6-9.

The submersible pump 10 in FIG. 1 further comprises a float control unit 400, used to detect a liquid surface position of a fluid source, and control the operation of the pumping unit based on the liquid surface position. Unlike existing designs, the float control unit 400 according to the present invention does not need to be connected to the submersible pump by electrical wires; instead, it is held on an outer wall of the submersible pump or formed as part of the outer wall of the submersible pump. Thus, during operation, there will not be any relative movement or colliding between the float control unit 400 and the submersible pump 10, and there is no risk of electrical wires being damaged or loosening and detaching.

Figure 2:
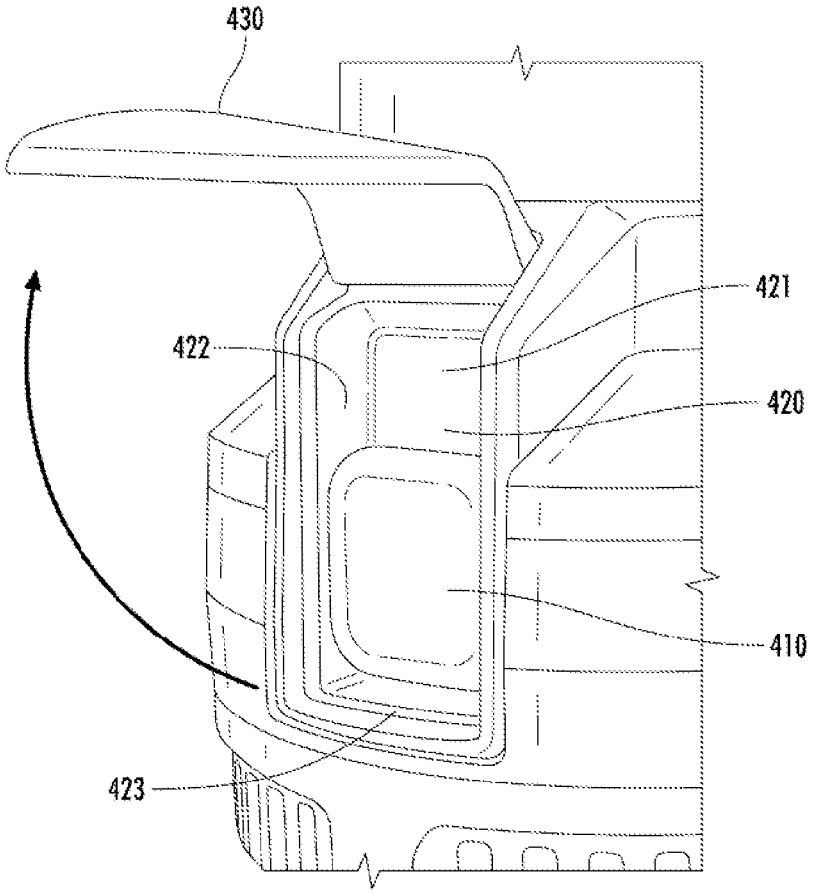
FIG. 2 shows a float control unit according to an embodiment of the present invention.

FIG. 2 shows an embodiment of the float control unit 400, comprising a float 410 and a float chamber housing 420. The float chamber housing 420 defines a float chamber in which the float 410 can move up and down. The float chamber has at least one opening 440 (shown in FIG. 1), which connects the float chamber with the external environment, to keep the liquid surface height in the float chamber the same as the liquid surface height of the fluid source.

At least part of the float chamber housing 420 is movably or removably attached to the outer wall of the submersible pump. In the embodiment of FIG. 2, the float chamber housing 420 comprises a cover 430; the cover 430 can move between an open position and a closed position. In other embodiments, the cover 430 is removably fitted to the float chamber housing 420, e.g. fixed to the outer wall of the submersible pump by fasteners. At least one, preferably multiple openings 440 are formed in or close to a bottom region of the cover 430. When the cover 430 is located at the open position, the float 410 can be contacted from the outside, so the user can replace or clean the float 410 without needing to remove the float chamber housing 420. In addition, the design of the openable cover allows the user to clean the float chamber to remove impurities therefrom, to avoid blockage of the opening 440. Preferably, at least part of the cover 430 is transparent or semi-transparent; this transparent or semi-transparent part can be used as a viewing window, to enable the user to view the situation inside the float chamber housing 420.

In some embodiments, at least part of the float chamber housing 420 is formed by the outer wall of the submersible pump. Taking FIG. 2 as an example, a rear wall 421, sidewalls 422 and a bottom wall 423 of the float chamber are all formed by the outer wall of the submersible pump. More specifically, the bottom wall 423 is formed by the pumping unit casing 200; the rear wall 421 and sidewalls 422 are formed by the drive unit casing 100 and the pumping unit casing 200 together. That is to say, in the embodiment of FIG. 2, part of the float chamber housing 420 is located on an outer wall of the drive unit casing 100, and another part is located on an outer wall of the pumping unit casing 200. Because the pumping unit casing 200 is closer to the base 30, the float control unit 400 can detect a lower liquid surface, and this enables the submersible pump to keep operating in low-liquid-surface environments, increasing the pumping efficiency. In other embodiments, the whole of the float chamber housing is located on the outer wall of the drive unit casing 100 or on the outer wall of the pumping unit casing 200. It could also be envisaged that the bottom wall 423 of the float chamber housing 420 is extended to the height of the base 300 so as to be positioned close to the height of the submersible pump inlet 20.

The cover 430 shown in FIG. 2 can pivot between the open position and closed position about a pivot shaft, which is fixed to the drive unit casing 100 and extends in a horizontal direction. When the cover 430 is located at the closed position, it forms a front wall of the float chamber. The front wall may be formed as part of the casing of the submersible pump 10. In other embodiments, the pivot shaft of the cover 430 may be disposed at the bottom of the float chamber housing 420, or designed to extend in the vertical direction. It should be understood that the manner of opening of the cover 430 is not limited to pivoting. For example, the cover may slide in the vertical or horizontal direction relative to the rear wall 421 and sidewalls 422 of the float chamber, or may be removed from the float chamber housing 420 directly.

To avoid accidental opening of the cover 420 when the submersible pump is operating, a biasing component may be provided for the cover 430 to hold it in the closed position. The biasing component may be a spring surrounding the pivot shaft; a biasing force towards the closed position is applied to the cover 420 by the spring. In another embodiment, a biasing force towards the open position may be applied to the cover 430 by the biasing component, to make the user aware that the cover 430 has not been closed correctly. The float chamber housing 420 may also comprise a locking mechanism for locking the cover 430 in the closed position. Before opening the cover 430, the user first needs to unlock the locking mechanism.

Only one float 410 is accommodated in the float chamber shown in FIG. 2; the width and thickness of the float 410 are close to the corresponding dimensions of the float chamber. Due to the matching dimensions, movement of the float 410 in the float chamber is limited to the up/down directions, and this helps to prevent undesired rotation of the float 410 in the float chamber, increasing the precision of liquid surface detection. It should be understood that there is no limitation to just one float 410. For example, two or more floats may be arranged side by side in the float chamber, and a controller stops the operation of the drive unit when a preset condition is met. The preset condition may be that all or most of the floats are lower than the minimum operating height, or that any one of the floats is lower than the minimum operating height. The float chamber may also be divided into multiple sub-chambers, with a float arranged in each sub-chamber. The controller can control the stopping and starting of the drive unit, and the drive speed thereof, based on the liquid surface heights detected by the multiple floats.

Optionally, a connection member is provided for the float 410; when the cover 430 accidentally opens, the connection member can prevent the float 410 from detaching from the float chamber housing 420 or the submersible pump, thus avoiding loss of the float. For example, the connection member may be a cord connecting the float 410 to the float chamber housing 420; the length of the cord is designed so that it will not hinder normal movement of the float 410 in the float chamber. The connection member may also comprise a retaining key formed on the float 410, and a guide slot formed on the rear wall or sidewall of the float chamber and used for accommodating the retaining key. The guide slot guides movement of the retaining key in the vertical direction, while preventing detachment of the retaining key from the guide slot. Thus, even if the cover 430 is opened, the float control unit can still operate normally. The connection member also prevents undesired loss of the float 410 when the float control unit is being cleaned.

A particular embodiment of the float control unit has been described above with reference to FIGS. 1-2, wherein the cover 430 of the float chamber housing 420 is movably or removably attached to the outer wall of the submersible pump, but the position of the float chamber relative to the submersible pump is fixed. In an embodiment which is not shown, the position of the float chamber relative to the submersible pump can be adjusted. For example, the whole float chamber housing 420 is formed as an independent housing, which can be attached to the outer wall of the submersible pump. The float chamber housing 420 can slide along the outer wall of the submersible pump in the vertical direction, or is removably fixed at different heights on the submersible pump's outer wall by means of a fastener or locking member. In some scenarios, the user might wish to retain a certain amount of fluid in the fluid source, in which case the user can change the minimum operating height of the submersible pump by adjusting the height of the float chamber.

In some embodiments, more than one float chamber housing 420 and float 410 therein may be provided. For example, three or more float chamber housings and floats located at different heights in the vertical direction are provided, wherein the float located in the lowest float chamber housing is used to control shutdown of the submersible pump, the float located in the float chamber housing at the middle height is used to control startup of the submersible pump, and the float located in the highest float chamber housing is used to control the submersible pump to issue an overflow alert to the user.

Figure 3:
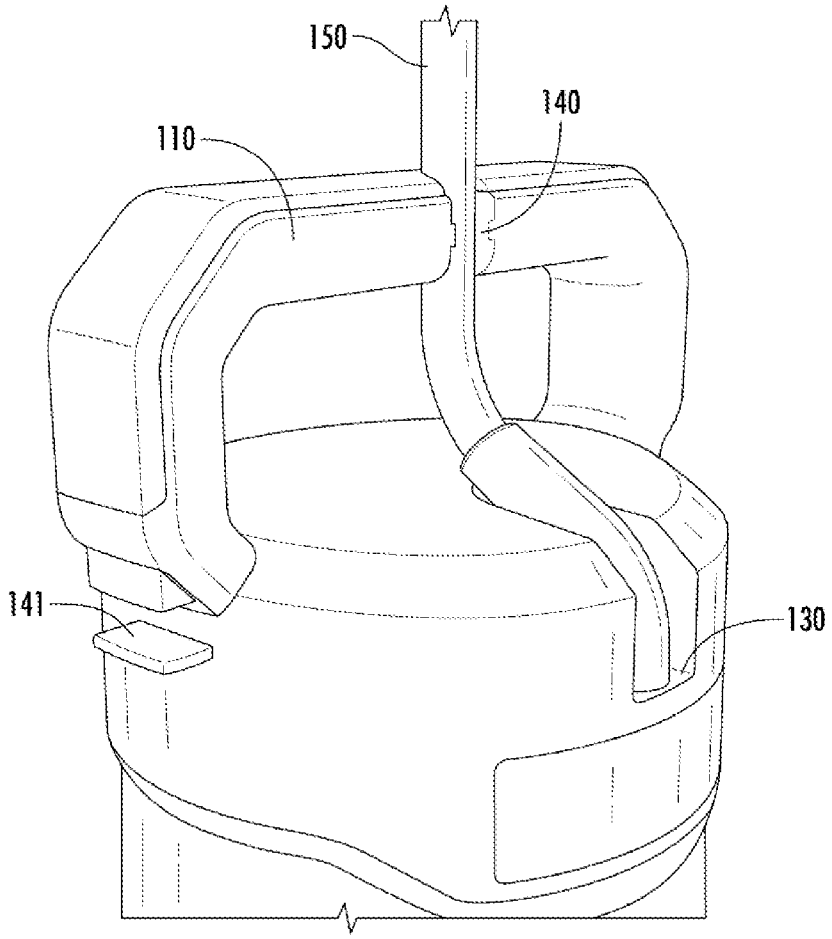
FIG. 3 shows an upper part of a submersible pump according to an embodiment of the present invention.

FIG. 3 shows an upper part of the drive unit casing 100 of the submersible pump. The submersible pump 10 comprises a handle 110 for a user to grip; the handle 110 may be formed integrally with the drive unit casing 100. In other embodiments, the handle 110 may be an independent component mounted on the drive unit casing 100, e.g. may rotate relative to the drive unit casing 100. The handle 110 comprises a grip, which may be covered with an elastic material such as rubber to improve comfort for the user when gripping the handle. Preferably, the grip of the handle 110 intersects a vertical line passing through the centre of gravity of the entire submersible pump. If the fluid source is not very deep, the handle 110 can serve as a placement assistance member of the submersible pump; while gripping the handle by hand, the user can place the submersible pump stably on the bottom wall of the fluid source.

When the fluid source is deeper, a longer placement assistance member is needed to help the user place the submersible pump. In this embodiment, a cable for transmitting electrical and/or control signals can serve as a placement assistance member. The user can use the cable to lift up the submersible pump, and then lower the submersible pump slowly while gripping the cable by hand, until the base of the submersible pump contacts the bottom wall of the fluid source. In the embodiment of FIG. 3, the cable projects from an edge 130 position of the drive unit casing 100. If the user uses the cable to lift up the submersible pump, the straight line on which the cable lies will pass through the edge 130 of the drive unit casing 100 and the centre of gravity of the submersible pump; this will result in the submersible pump being tilted relative to the horizontal direction. Tilting of the submersible pump is undesirable, because the tilted base might not be able to be stably supported on the bottom wall of the fluid source.

To solve this problem, a cable retaining part is provided on the submersible pump. In this embodiment, the cable retaining part is designed as a retaining slot 140 on the handle 110; the retaining slot 140 is located substantially in the middle of the handle 110 and extends in the vertical direction, so that when the user uses the cable 150 to lift up the submersible pump, the submersible pump does not tilt obviously and the bottom 300 of the submersible pump can maintain a substantially horizontal orientation. Furthermore, for convenience of cable storage, at least one retaining slot 141 may be formed on the outer wall of the submersible pump casing. When not using the submersible pump, the user can coil the cable 150 around the casing, and the retaining slot 141 on the outer wall is used to fix the cable, to prevent the cable from loosening and detaching.

Figure 4:
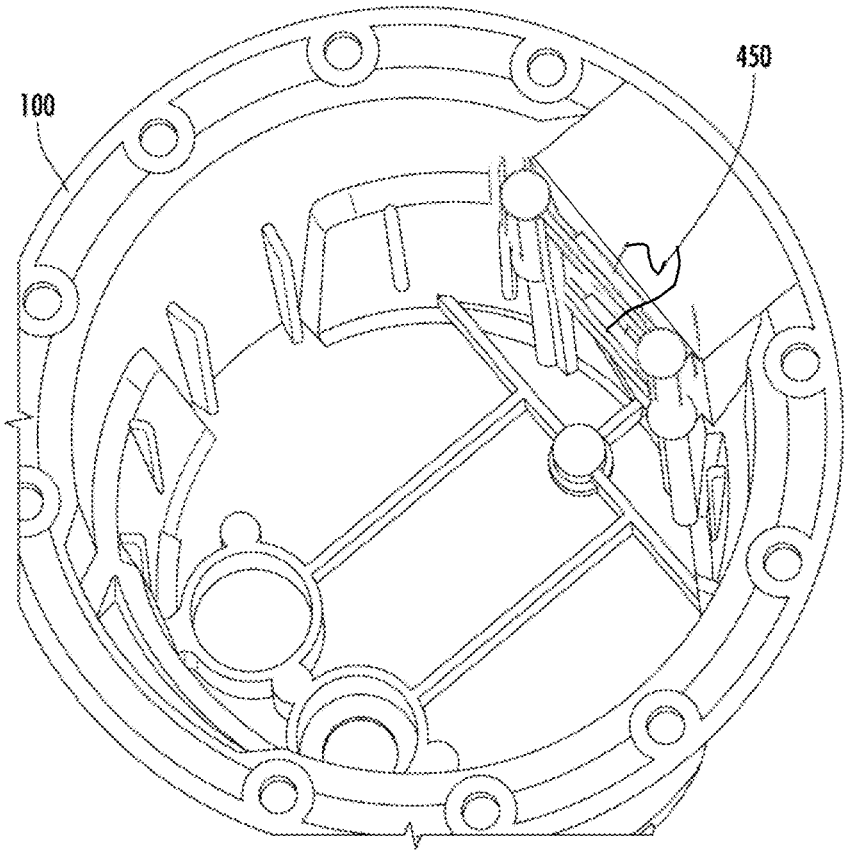
FIG. 4 shows the interior of a drive unit casing according to an embodiment of the present invention.

The float control unit 400 further comprises at least one control element, which controls the pumping unit in response to the height of the float 410. FIG. 4 shows the position of a control element 450 inside the drive unit casing 100, close to the float chamber housing 420. For example, the control element 450 may be mounted on an inner wall of the drive unit casing 100. Preferably, the control element 450 comprises a non-contact sensor, which is able to sense the position of the float 410 without contacting the float 410, so as to judge the liquid surface height of the fluid source. The float 410 may comprise at least one magnet, which may be positioned inside the float 410 or fixed to an outer surface of the float. The control element 450 can judge the position of the float 410 by sensing a magnetic field.

Figure 5:
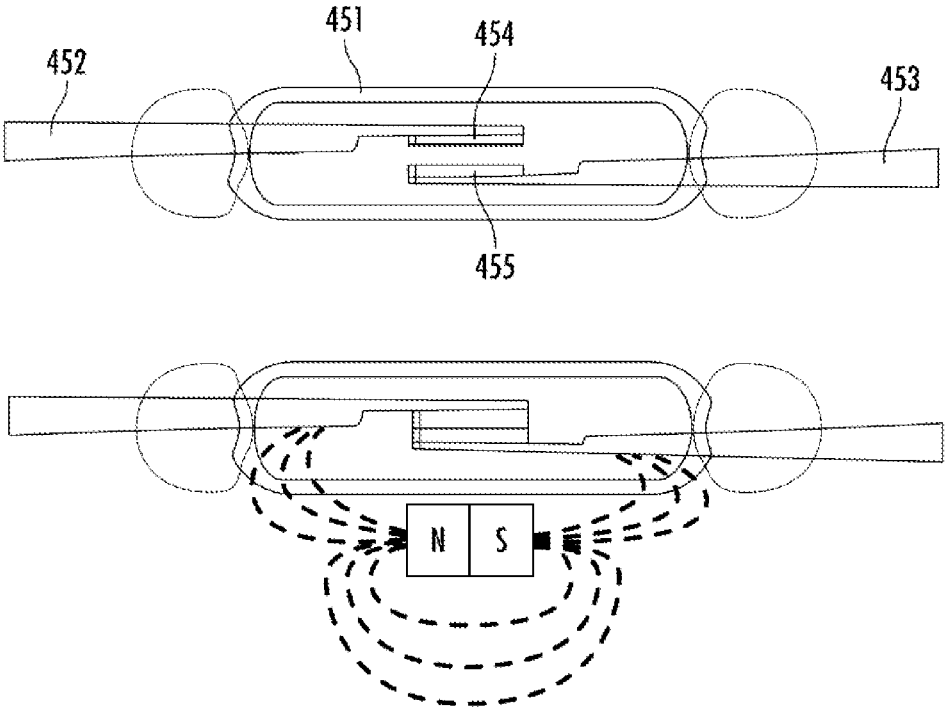
FIG. 5 shows a control element according to an embodiment of the present invention.

The control element 450 may be the reed switch shown in FIG. 5, which comprises a pair of magnetizable, flexible metal reeds 452, 453. The metal reeds are sealed in a tubular glass casing 451, with a gap between end parts 454, 455 of the metal reeds 452, 453. When the float 410 moves to a position close to the reed switch, the magnetic field from the magnet in the float 410 will cause the metal reeds 452, 453 to attract each other, thereby completing a circuit. When the float 410 moves to a position remote from the reed switch, the spring force causes the metal reeds 452, 453 to separate and break the circuit.

In an embodiment which is not shown, the float control unit 400 comprises multiple control elements 450 respectively positioned at different heights in the drive unit casing 100. The submersible pump controller can control the operation of the submersible pump based on any one of the multiple control elements 450. For example, the multiple control elements 450 may be configured to correspond to different minimum operating heights. The multiple control elements 450 may also be configured to correspond to different operating speeds, with the controller changing the pumping speed as the liquid surface rises/falls. If the user wishes to keep the liquid surface height of the fluid source within a particular range, he can select two of the multiple control elements 450 as the minimum operating height and maximum operating height of the submersible pump. Optionally, the position of the control element 450 can be adjusted without removing the drive unit casing 100, to allow the user to precisely set the minimum and/or maximum operating height(s) as required. For example, an actuator that can be controlled from the outside may be provided for the control element 450, or a height adjustment member of the control element 450 may be provided on the outer wall of the submersible pump.

In some embodiments, the float control unit may be combined with a delay unit. The effect of the delay unit is that the startup and/or shutdown of the submersible pump is controlled only after a certain amount of time has elapsed since triggering of the float control unit.

Figure 6:
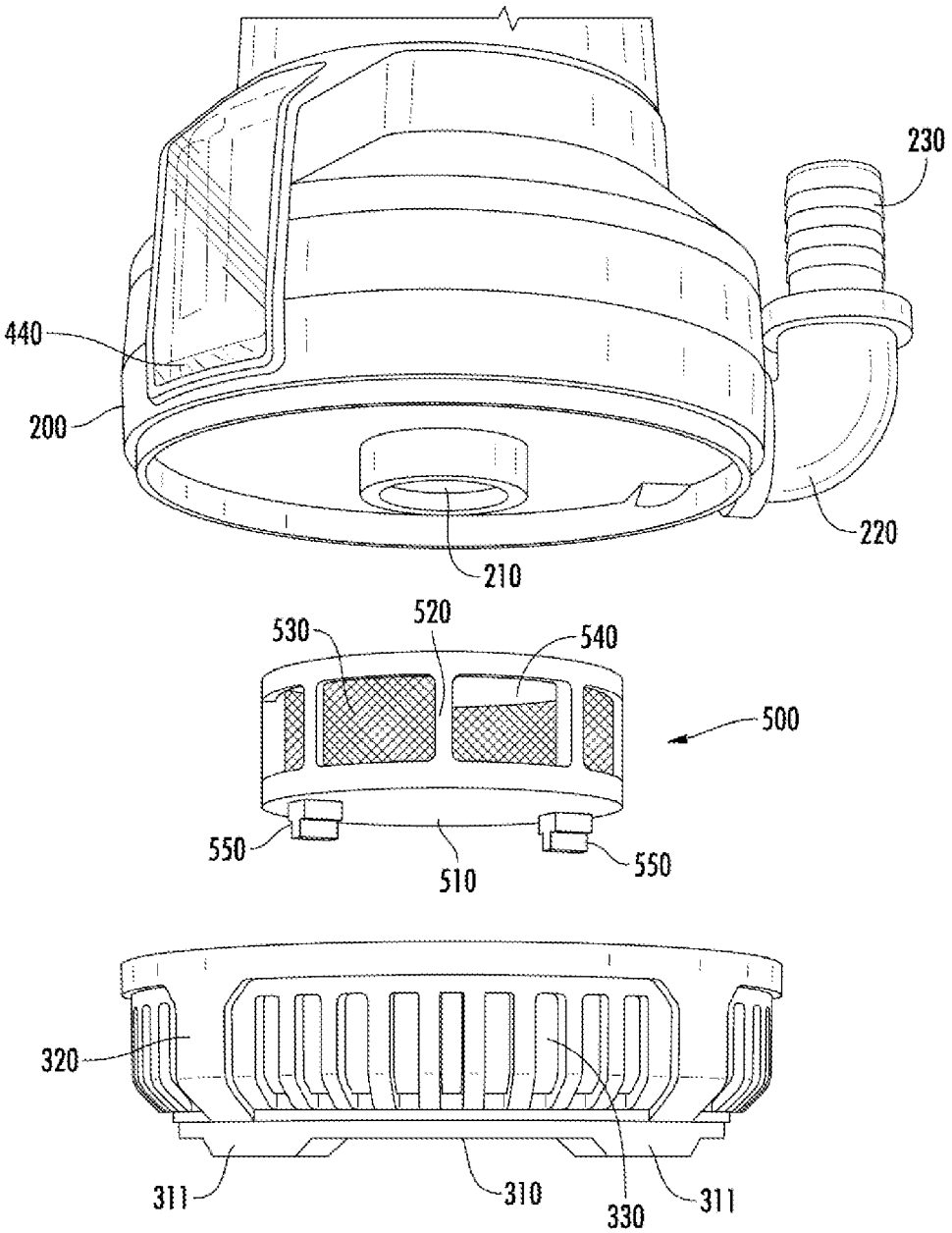
FIG. 6 shows a pump inlet adjustment mechanism according to an embodiment of the present invention.

FIG. 6 shows the pumping unit casing 200 and base 300 of the submersible pump. A pumping chamber is defined in the pumping unit casing 200; an inlet 210 of the pumping chamber is formed at the centre of the bottom of the pumping unit casing 200, and an outlet of the pumping chamber is formed at a side of the pumping unit casing 200. In this embodiment, the outlet of the pumping chamber is constructed as a curved tube 220 projecting from the outer wall of the pumping unit casing 200; a duct adapter 230 is provided on the curved tube 220, and used to connect a drainage tube, e.g. a garden hose. In the embodiment shown in FIG. 9, the curved tube 220 is pivotable, for example between a horizontal setting and a vertical setting. The pumping chamber may be a vortex chamber, with an impeller accommodated therein, the impeller being driven by an electric motor arranged in the drive unit casing 100. In an embodiment, the height of the opening 440 of the float chamber is positioned to be equal to or lower than the height of the top of the pumping chamber.

The base 300 comprises a bottom wall 310, and a sidewall 320 extending upwards from the bottom wall. Multiple long, narrow slots 330 are formed in the sidewall 320, and these serve as the inlet 20 of the submersible pump. In some embodiments, the long, narrow slots 330 may extend to the bottom wall 310. When the submersible pump is operating, fluid enters the base through the long, narrow slots 330, then enters the pumping chamber through the inlet 210 of the pumping chamber, and is discharged through the curved tube 220 under the driving action of the impeller. The multiple long, narrow slots 330 can achieve a crude filtration effect. Although the long, narrow slots 330 can block some foreign objects of larger size, smaller particulate impurities will still enter the pumping chamber along with the fluid.

According to one aspect of the present invention, to improve the submersible pump's ability to adapt to different application scenarios, a pump inlet adjustment mechanism is provided in the submersible pump. The pump inlet adjustment mechanism is positioned on a flow path between the pump inlet and the pumping chamber, and used to optionally change the submersible pump's ability to filter impurities. The pump inlet adjustment mechanism may comprise a first adjustment part and a second adjustment part capable of moving relative to each other, each of the first adjustment part and second adjustment part comprising multiple adjustment regions with different fluid permeabilities. Relative movement between the first adjustment part and second adjustment part can change the effective dimensions of the flow path.

Figure 7A:
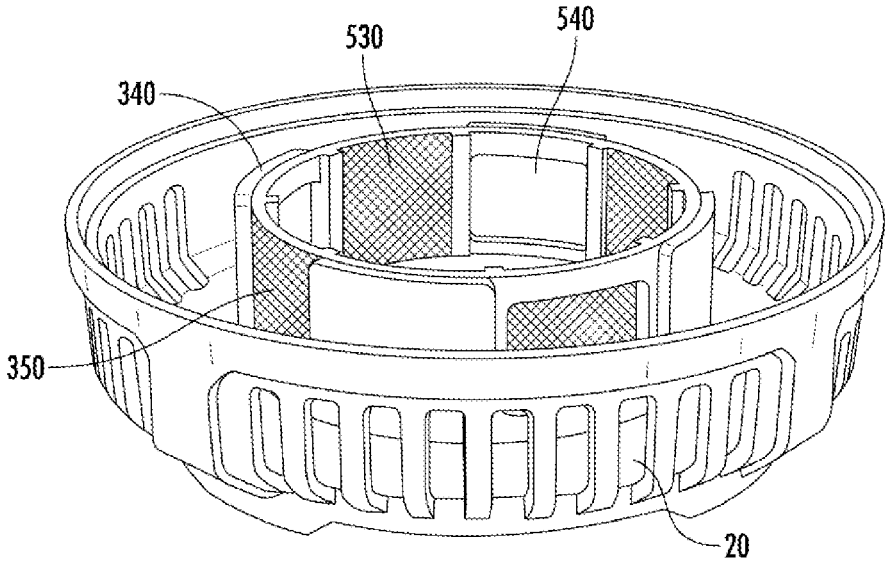
FIG. 7*a* shows a pump inlet adjustment mechanism in a filtration position.
Figure 7B:
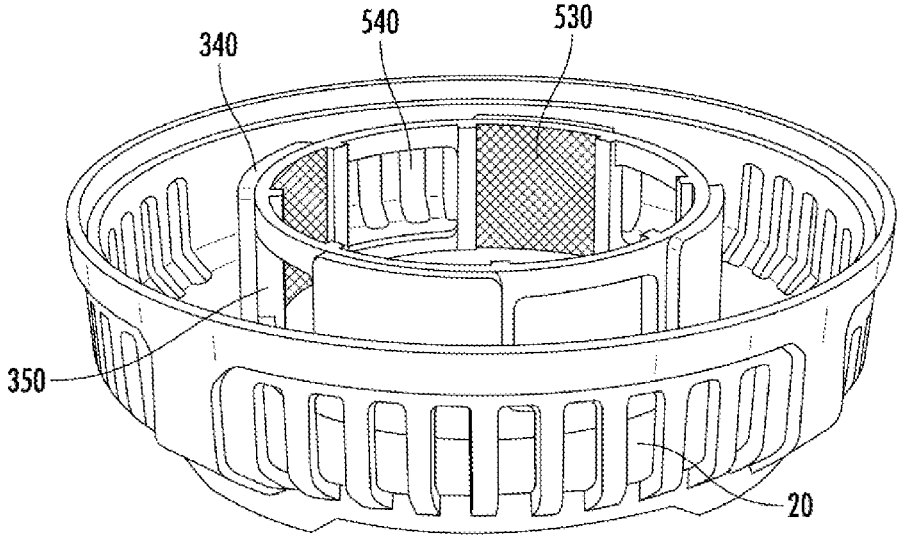
FIG. 7*b* shows a pump inlet adjustment mechanism in a non-filtration position.
Figure 8:
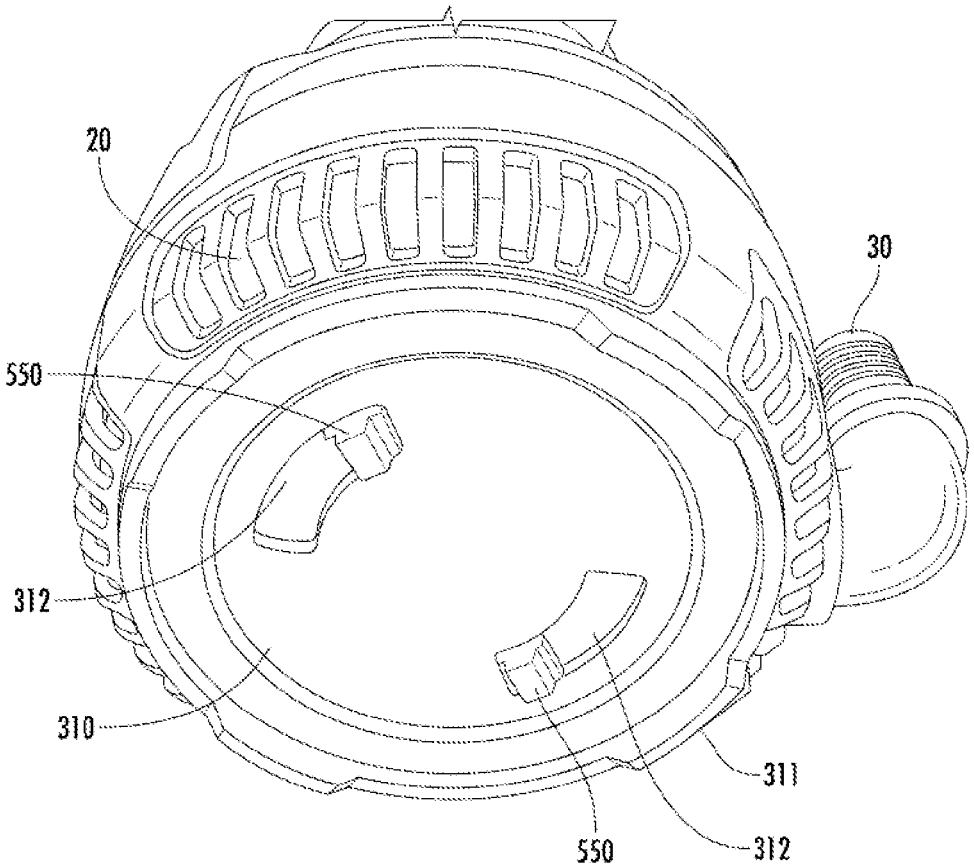
FIG. 8 shows the bottom of a submersible pump according to an embodiment of the present invention.
Figure 9:
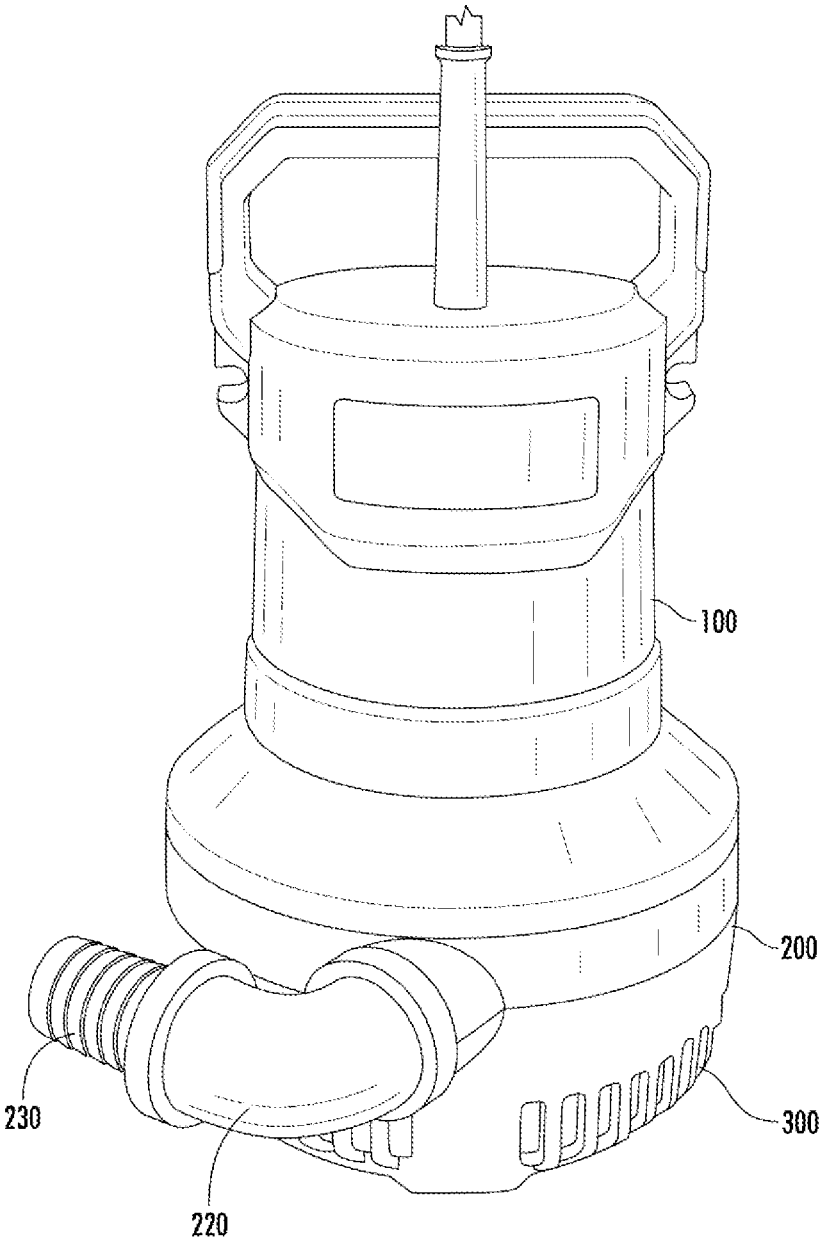
FIG. 9 shows a submersible pump with a pivotable curved tube according to an embodiment of the present invention.

FIGS. 6-8 show an embodiment of the pump inlet adjustment mechanism. The first adjustment part comprises an adjustment ring 500, with multiple adjustment regions being distributed at a side of the adjustment ring 500. The adjustment regions comprise filtration regions 530 and non-filtration regions 540 distributed alternately, with adjacent adjustment regions being separated by a separating member 520. The filtration regions 530 may be defined by filter mesh; the non-filtration regions 540 are penetrating openings. In this embodiment, the filtration regions 530 and non-filtration regions 540 have substantially the same areas. The non-filtration regions 540 have the maximum fluid permeability; fluid will not be obstructed in the process of entering the pumping chamber through the non-filtration regions 540. It must be explained that although the non-filtration regions 540 shown in the figure are penetrating openings, it is by no means true that the non-filtration openings cannot have any filtration ability. In some embodiments, the filtration regions 530 and non-filtration regions 540 may comprise filter meshes with different effective dimensions, with the filtration ability of the non-filtration regions being lower than that of the filtration regions.

Referring to FIGS. 7*a*-7*b*, the second adjustment part of the pump inlet adjustment mechanism comprises blocking regions 340 and open regions 350 arranged in the circumferential direction. The blocking regions 340 may be connected to the base 300 or formed integrally with the base 300, and the open regions 350 are defined between adjacent blocking regions 340. The blocking regions 340 comprise multiple baffles extending upwards from the bottom wall 310 of the base 300, and the open regions 350 are the spaces between adjacent baffles. The dimensions of the blocking regions 340 and the open regions 350 are designed to match the filtration regions 530 and non-filtration regions 540.

In this embodiment, the blocking regions 340 are fixed relative to the base 300, and the adjustment ring 500 is rotatably mounted in the base 300, with the blocking regions 340 being used as positioning components for the adjustment ring 500. In other embodiments, the adjustment ring 500 is fixed relative to the base 300 and the blocking regions 340 are movably mounted in the base 300, or both the adjustment ring 500 and the blocking regions 340 are movable relative to the base 300. FIG. 7*a* shows the pump inlet adjustment mechanism in a filtration position. At this time, the non-filtration regions 540 in the first adjustment part are aligned with the blocking regions 340 in the second adjustment part, and the filtration regions 530 in the first adjustment part are aligned with the open regions 350 in the second adjustment part. Fluid entering through the pump inlet 20 must pass through the filtration regions 530 in order to enter the pumping chamber; the filtration regions 530 cause a reduction in the effective dimensions of the flow path between the pump inlet and the pumping chamber. FIG. 7*b* shows the pump inlet adjustment mechanism in a non-filtration position. At this time, the filtration regions 530 are aligned with the blocking regions 340, and the non-filtration regions 540 are aligned with the open regions 350. Fluid entering through the pump inlet 20 enters the pumping chamber through the non-filtration regions 540; because the filtration regions 530 have no effect, the effective dimensions of the flow path between the pump inlet and the pumping chamber are increased. It can be envisaged that the adjustment ring 500 is replaceable, with different adjustment rings 500 having different filtration capabilities in order to adapt to a variety of tasks.

To make it easy for the user to operate the pump inlet adjustment mechanism from the outside, at least one operating part 550 is provided on the adjustment ring 500. FIG. 8 shows the structure of the bottom of the submersible pump. At least one slot 312 is formed in the bottom wall 310 of the base 300, and the operating part 550 passes through the slot 312. In this embodiment, the slot 312 is a long, narrow arc-shaped slot, used to guide movement of the operating part 550. The user turns the adjustment ring 500 by sliding the operating part 550, thereby changing the position of the first adjustment part relative to the second adjustment part. For example, when the submersible pump is being used as a dirty water pump, the user slides the operating part 550 towards one end of the slot 312, moving the pump inlet adjustment mechanism to the non-filtration position in FIG. 7*b*. When the submersible pump is being used as a clean water pump, the user slides the operating part 550 towards the other end of the slot 312, moving the pump inlet adjustment mechanism to the filtration position in FIG. 7*a*, the increase the submersible pump's ability to filter particles and impurities. In addition, to prevent the base from wobbling, at least one support leg 311 may be provided on the bottom wall 310 of the base 300, the height thereof being greater than or equal to the distance by which the operating part 550 protrudes from the bottom wall 310.

Although the present invention has been explained in detail with reference to limited embodiments, it should be understood that the present invention is not restricted to these disclosed embodiments. Those skilled in the art may envisage other embodiments conforming to the spirit and scope of the present invention, including changes to the numbers of components, alterations, substitutions or equivalent arrangements, all such embodiments falling within the scope of the present invention.

The invention claimed is:

1. A float control unit for a submersible pump, comprising:

a float, having at least one magnet;

a float chamber housing, defining a float chamber in which the float is movable up and down, the float chamber having at least one opening which connects the float chamber with an environment external to the submersible pump, the float chamber housing comprising a cover capable of moving between an open position and a closed position, wherein the cover is pivotable relative to the outer wall of the submersible pump;

wherein at least part of the float chamber housing is movably or removably attached to an outer wall of the submersible pump.

2. The float control unit according to claim 1, wherein the float is contactable from outside of the chamber housing when the cover is located at the open position, and at least part of the cover being transparent or semi-transparent.

3. The float control unit according to claim 1, wherein at least part of the float chamber housing is formed by the outer wall of the submersible pump.

4. The float control unit according to claim 2, wherein the cover is fixed to the outer wall of the submersible pump by a fastener.

5. The float control unit according to claim 1, wherein the float control unit further comprises a connection member which prevents detachment of the float from the float chamber housing.

6. The float control unit according to claim 1, wherein the position of the float chamber relative to the submersible pump is adjustable.

7. A submersible pump, comprising:

a casing, having accommodated therein a pumping unit and a drive unit for driving the pumping unit;

a base, defining a pump inlet; and the float control unit according to claim 1, at least part of the float chamber housing being movably or removably attached to an outer wall of the casing.

8. The submersible pump according to claim 7, wherein the casing comprises a drive unit casing and a pumping unit casing, the pumping unit casing being located between the drive unit casing and the base, and at least part of the float chamber housing being located on an outer wall of the pumping unit casing.

9. The submersible pump according to claim 8, wherein the pumping unit casing defines a pumping chamber, a height of the opening of the float chamber being equal to or lower than a height of a top end of the pumping chamber.

10. The submersible pump according to claim 7, wherein a rear wall, a sidewall and a bottom wall of the float chamber are formed by the drive unit casing and/or the pumping unit casing, and when in a closed position, the cover forms a front wall of the float chamber.

11. The submersible pump according to claim 7, wherein the float control unit further comprises at least one control element which controls the pumping unit in response to a height of the float.

12. The submersible pump according to claim 11, wherein the at least one control element is located inside the casing.

13. The submersible pump according to claim 11, wherein the float control unit comprises multiple control elements respectively positioned at different heights in the casing.

14. The submersible pump according to claim 11, wherein a position of the control element is adjustable.

15. The submersible pump according to claim 7, further comprising a pump inlet adjustment mechanism arranged on a flow path between the pump inlet and a pumping chamber, the pump inlet adjustment mechanism comprising a first adjustment part and a second adjustment part capable of moving relative to each other, each of the first adjustment part and second adjustment part comprising multiple adjustment regions with different fluid permeabilities, and relative movement between the first adjustment part and the second adjustment part being able to change an effective dimension of the flow path.

16. The submersible pump according to claim 15, wherein the first adjustment part comprises an adjustment ring on which multiple adjustment regions are distributed, the adjustment ring being rotatable about a central axis thereof relative to the second adjustment part.

17. The submersible pump according to claim 16, wherein the adjustment ring comprises filtration regions and non-filtration regions distributed alternately.

18. The submersible pump according to claim 17, wherein the second adjustment part comprises blocking regions and open regions arranged in a circumferential direction, the blocking regions being connected to the base or formed integrally with the base, and the open regions being defined between adjacent blocking regions; the effective dimension of the flow path is increased by aligning the non-filtration regions of the adjustment ring with the open regions, and the effective dimension of the flow path is decreased by aligning the filtration regions of the adjustment ring with the open regions.

19. The submersible pump according to claim 15, wherein the pump inlet adjustment mechanism comprises at least one operating part, the at least one operating part being used to control relative movement between the first adjustment part and the second adjustment part.

20. The submersible pump according to claim 19, wherein the at least one operating part passes through at least one slot formed in a bottom wall of the base.

21. The submersible pump according to claim 7, further comprising at least one cable retaining slot for retaining a cable, the cable retaining slot being formed on the outer wall of the casing and/or on a handle of the submersible pump.

* * * * *